US012290855B2

(12) United States Patent
Schirmer

(10) Patent No.: US 12,290,855 B2
(45) Date of Patent: May 6, 2025

(54) SINGLE-PIECE FEEDER BODY FOR USE IN METAL CASTING

(71) Applicant: Chemex Foundry Solutions GmbH, Delligsen (DE)

(72) Inventor: Heiko Schirmer, Delligsen (DE)

(73) Assignee: CHEMEX FOUNDRY SOLUTIONS GMBH, Delligsen (DE)

( * ) Notice: Subject to any disclaimer, the term of this patent is extended or adjusted under 35 U.S.C. 154(b) by 827 days.

(21) Appl. No.: 17/413,805

(22) PCT Filed: Jan. 9, 2020

(86) PCT No.: PCT/EP2020/050360
§ 371 (c)(1),
(2) Date: Jun. 14, 2021

(87) PCT Pub. No.: WO2020/156770
PCT Pub. Date: Aug. 6, 2020

(65) Prior Publication Data

US 2022/0008985 A1 Jan. 13, 2022

(30) Foreign Application Priority Data

Jan. 31, 2019 (DE) ..... 102019102449.8

(51) Int. Cl.
*B22C 9/08* (2006.01)

(52) U.S. Cl.
CPC ..... *B22C 9/088* (2013.01)

(58) Field of Classification Search
CPC ..... B22C 9/088; B22C 9/082; B22D 17/2023
See application file for complete search history.

(56) References Cited

U.S. PATENT DOCUMENTS

| | | | | |
|---|---|---|---|---|
| 11,446,733 | B2 * | 9/2022 | Zumbusch | B22C 9/088 |
| 2004/0256075 | A1 | 12/2004 | Schafer | |
| 2005/0236132 | A1 | 10/2005 | Powell | |
| 2009/0014482 | A1 | 1/2009 | Tackaberry | |
| 2009/0301684 | A1 | 12/2009 | Beckmann | |

(Continued)

FOREIGN PATENT DOCUMENTS

| | | | |
|---|---|---|---|
| CN | 105522115 | A | 4/2016 |
| CN | 105644926 | A | 6/2016 |

(Continued)

*Primary Examiner* — Keith D. Hendricks
*Assistant Examiner* — Moriah S. Smoot
(74) *Attorney, Agent, or Firm* — DUANE MORRIS LLP; Gregory M. Lefkowitz; Brandon A. Chan

(57) ABSTRACT

The invention relates to a single-piece feeder body for use as a component of a two-part or multi-part telescopic feeder insert in metal casting, having a feeder wall which at least partially delimits a feeder cavity for receiving liquid metal, wherein the feeder wall has

Figure 1:
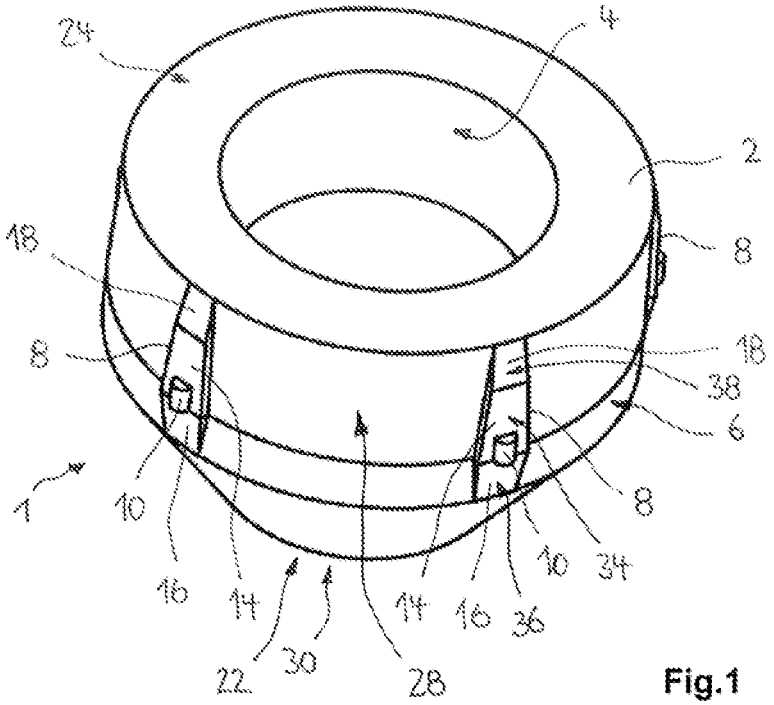

- a passage opening for the liquid metal into the feeder cavity, and
- an outer surface on which there are arranged at least one outwardly projecting holding element and at least one guide part with a sliding section for a feeder element which corresponds with the feeder body, wherein the guide part has a supporting section which protrudes outwardly on the outer surface and which, adjoining the sliding section of the guide part for guiding the feeder element, extends in the direction of the passage opening.

19 Claims, 5 Drawing Sheets

(56) References Cited

U.S. PATENT DOCUMENTS

| | | | | |
|---|---|---|---|---|
| 2015/0096707 | A1 | 4/2015 | Hintze | |
| 2016/0030999 | A1 | 2/2016 | Zumbusch | |
| 2016/0101461 | A1 | 4/2016 | Beckmann | |
| 2017/0209917 | A1* | 7/2017 | Volks | B22C 9/02 |
| 2018/0290203 | A1* | 10/2018 | Volks | B22C 9/084 |

FOREIGN PATENT DOCUMENTS

| | | | | |
|---|---|---|---|---|
| CN | 207464123 | U | 6/2018 | |
| DE | 3247317 | | 6/1984 | |
| DE | 20122062 | U1 | 2/2004 | |
| DE | 202015104866 | | 11/2015 | |
| DE | 202016103215 | | 6/2017 | |
| DE | 202018102896 | | 7/2018 | |
| EP | 1184104 | | 3/2002 | |
| EP | 1184104 | B1 * | 12/2004 | B22C 9/088 |
| EP | 2431111 | | 3/2012 | |
| JP | H09103864 | | 4/1997 | |
| WO | WO-9701406 | A1 * | 1/1997 | B22C 9/088 |
| WO | 2017072004 | A1 | 5/2017 | |

* cited by examiner

SINGLE-PIECE FEEDER BODY FOR USE IN METAL CASTING

CROSS-REFERENCE TO RELATED APPLICATIONS

This application is a § 371 national stage entry of International Application No. PCT/EP2020/050360, filed on Jan. 9, 2020, which claims priority to German Patent Application No. 102019102449.8, filed on Jan. 31, 2019, the entire contents of which are incorporated herein by reference.

The invention relates to a single-piece feeder body for use as a component of a two-part or multi-part telescopic feeder insert in metal casting, having a feeder wall which at least partially delimits a feeder cavity for receiving liquid metal, wherein the feeder wall has a passage opening for the liquid metal into the feeder cavity, and an outer surface on which there are arranged at least one outwardly projecting holding element and at least one guide part with a sliding section for a feeder element which corresponds with the feeder body. The invention furthermore relates to a two-part or multi-part feeder insert for use in metal casting in casting molds, and to a kit for producing feeder inserts.

A multitude and variety of single-piece feeder bodies are used in metal casting in casting molds. Such feeder bodies are commonly part of a feeder insert, also referred to as feeder system. Such a single-piece feeder body, which, during casting operation, forms a two-part or multi-part telescopic feeder insert together with a feeder element, is externally at least regionally surrounded by a mold material used for producing a casting mold, for example mold sand. Within the casting mold to be produced, the feeder body and the feeder insert partially formed therefrom should be held in a fixed position in relation to a mold cavity, which is to be filled by the metal during the casting process, in the casting mold. Known single-piece feeder bodies have a feeder wall by means of which a feeder cavity for receiving liquid metal is at least partially delimited. The feeder wall of the feeder body commonly has an inner surface which at least partially defines the feeder cavity of the feeder insert. The feeder wall furthermore comprises a passage opening for the liquid metal into the feeder cavity. During the casting process, a partial quantity of the liquid metal used for the casting passes into said feeder cavity via the passage opening. The metal situated in the feeder cavity of the feeder insert serves for the refeeding of the cast part, which is kept in the liquid state for a certain period of time until the metal present in the casting mold has at least partially solidified.

In order to be able to withstand the high pressures that nowadays act on the mold material during the production of the casting mold, feeder inserts or feeder systems are used which are variable in terms of their overall height during the pressing of the mold material to form a finished mold part.

The publication EP 1 184 104 A1 has disclosed a feeder insert for use in metal casting, which feeder insert comprises two mold elements which are displaceable one inside the other along the feeder longitudinal axis of said feeder insert and which delimit the feeder cavity for receiving the liquid metal. During the compaction process, it is thus the case that one mold element is pushed into the other mold element, or the other mold element is pushed over the former mold element. In order to fix the two mold elements in an initial position prior to the compression process, holding elements are provided on one of the mold elements, which holding elements are configured for bearing the respective other mold element. If the pressure exceeds a predetermined value during the pressing of the mold material, the holding elements on the former mold element are severed or deformed such that a relative movement between the two mold elements is possible.

Reference is furthermore made to the following prior art: DE 10 2006 055 988 A1, DE 10 2013 102 381 A1, DE 20 2015 104 866 U1, DE 20 2016 103 215 U1, DE 20 2018 102 896 U1 and US 2009/0014482 A1.

Aside from the temporary holding of the individual parts, which are movable relative to one another, of the feeder insert in an initial position by means of the holding elements, the targeted guidance during the relative movement of feeder body and feeder element with respect to one another, and thus during the telescoping of the feeder insert, has also become ever more crucial for a smooth production process of the casting mold. The relative movement between the feeder body and a feeder element of the feeder insert is controlled by means of at least one guide part arranged on the outer surface of the feeder body. The guide part has a sliding section for a feeder element which corresponds with the feeder body, along which sliding section in particular the inner side of the feeder element slides as the mold material is compacted. The guide part commonly projects on the outer surface of the feeder wall, such that the inner side of the feeder element is borne only partially, specifically via the one or more guide parts, by the feeder wall. In the past, the guide part that extends over a section along the outer surface of the feeder body has commonly been at least partially broken away already prior to the intended use of the feeder body. This has had the effect that the feeder element which is received movably relative to the feeder body is then guided unevenly relative to the feeder body, with the resulting risk of misalignment or tilting of the feeder element relative to the feeder body.

Proceeding from the problem set out above, it is the object of the invention to specify a single-piece feeder body and a feeder insert, by means of which an improved relative movement between feeder body and feeder element, and thus improved telescoping of the feeder insert, in particular avoiding the disadvantages described above, are made possible.

The invention solves the problem on which it is based by means of a feeder body for use as a component of a two-part or multi-part telescopic feeder insert in metal casting, having the features according to claim 1. According to the invention, the guide part has a supporting section which protrudes outwardly on the outer surface and which, adjoining the sliding section of the guide part for guiding the feeder element, extends in the direction of the passage opening.

The invention thus relates to a single-piece feeder body which has a feeder wall which at least partially delimits a feeder cavity for receiving liquid metal. The feeder wall comprises a passage opening for the liquid metal into the feeder cavity. Furthermore, a mounting region for the mounting of the feeder body on a mold model and/or on a mold plate is preferably provided on the outer surface in the region of the passage opening of the feeder wall. Here, the invention utilizes the realization that the guide part, which in the prior art ends with a shoulder at the free end of its sliding section, is provided with increased strength by way of a supporting section. With the supporting section, the guide part can better withstand external mechanical influences, such as forces acting thereon. Thus, a premature breakaway or deformation of the guide part prior to its intended use, specifically when the inner side of the feeder element slides along it, is already prevented. Furthermore, with the provision of the supporting section, the guide part also better withstands the forces that occur during the telescoping of feeder body and feeder element relative to one another. In the case of an in particular vertical orientation of the feeder longitudinal axis of the feeder body, the supporting section preferably extends downward, and thus in the direction of the passage opening on the feeder wall, proceeding from the sliding section of the guide part. The supporting section, like the guide part, protrudes on the outer surface of the feeder wall, such that the step at the lower end of the sliding section of the guide part is at least reduced and preferably compensated entirely. In this way, during the sliding of the feeder element along the guide part, a friction force acting on the sliding section is dissipated from the sliding section via the supporting section into adjoining regions of the feeder wall.

According to a preferred refinement of the feeder body according to the invention, the sliding section has a sliding surface and the supporting section has a terminating surface, wherein the sliding surface runs so as to be inclined at an angle $\alpha 1$ with respect to the central axis, and the terminating surface runs so as to be inclined at an angle $\alpha 2$ with respect to the central axis of the passage opening, wherein the angles open in opposite directions. By means of the configuration according to the invention of the supporting section, it is achieved that, during the relative movement of feeder body and feeder element with respect to one another, no friction action is exerted on the supporting section itself by the inner side of the feeder element. Preferably, the sliding surface on the sliding section and the terminating surface on the supporting section of the feeder body according to the invention are inclined in opposite directions with respect to the central axis of the passage opening. Preferably, the sliding surface thus widens in the movement direction of the feeder element that is moved relative to the feeder body. The widening sliding surface of the guide part thus at least partially counteracts the sliding movement of the feeder element relative to the feeder body. By contrast, the terminating surface of the supporting section is inclined in the opposite direction, such that it is ensured that said terminating surface does not come into contact with the inner side of the feeder element.

It is preferable if, on the feeder body according to the invention, multiple guide parts are arranged at angular intervals with respect to one another about the central axis of the passage opening, preferably at uniform angular intervals about the central axis of the passage opening. The provision of multiple guide parts on the feeder wall gives rise to improved guidance of the feeder element that is movable relative to the feeder body. Furthermore, by means of multiple guide parts that are arranged so as to be distributed preferably uniformly on the outer surface of the feeder wall, a friction action which is distributed more uniformly along the circumference arises during the relative displacement of feeder body and feeder element one inside the other. Preferably, the feeder body has at least three, four, five or more such guide parts according to the invention on its outer surface.

A preferred configuration of the single-piece feeder body according to the invention provides that five guide parts are arranged with an angular offset of preferably approximately 72 angular degrees with respect to one another on the outer surface. With the provision of five guide parts on the outer surface of the feeder wall, a preferably exact radial orientation of the longitudinal axis of the feeder element with respect to the longitudinal axis of the feeder body is attained. Furthermore, with preferably five guide parts, it is achieved that, in the event of the breakaway of one of the guide parts on the outer side of the feeder wall, the remaining guide parts can ensure not only the guidance of the feeder element relative to the feeder body but also preferably the radial orientation and thus the desired concentricity between feeder element and feeder body.

Preferably, the feeder body according to the invention has a first end, which defines the passage opening, and a second end, which is situated opposite the passage opening, wherein, preferably, the supporting section has a step-free transition to the sliding section, and/or, in the direction of the second end of the feeder body, ends at the outer surface of the feeder wall in a step-free manner. The feeder body is preferably positioned with its first end, at which the passage opening for the liquid metal is formed, on a mold plate. The feeder body according to the invention is thus, during the production of the casting mold, fixed relative to the mold plate which defines at least a part of the outer contour of the casting mold. The feeder body furthermore has a second, preferably open end, which can be assigned to the feeder element, which is movable relative to the feeder body, of a feeder insert. Preferably, the connection to the feeder element is realized by the open end, wherein feeder body and feeder element then together define the feeder cavity.

In particular, a step-free transition is formed between the supporting section, which protrudes on the outer side of the feeder wall, and the sliding section of the guide part. A step-free transition between the sliding surface of the sliding section and the terminating surface of the supporting section on the guide part is also to be understood to mean the provision of an edge if both preferably planar surfaces of sliding section and supporting section end at the same height as one another at the transition. In the direction of its second end, too, the supporting section has a step-free transition from its terminating surface to the outer surface of the feeder wall which is adjacent at the end side. An improved force flow from the supporting section into the structure, which bears the supporting section, of the feeder wall is thus also realized. A material failure and an associated breakaway of the guide part on the feeder wall prior to or during intended use is thus further reduced.

A preferred refinement of the feeder body according to the invention provides that the one or more guide parts has a mounting section which extends from the sliding section in the direction of the second end and which preferably protrudes on the outer surface. With the provision of a mounting section which is arranged at the opposite end of the sliding section in relation to the supporting section, it is made easier for the feeder element used for forming a feeder insert to be mounted on or brought into contact with the feeder body according to the invention. The mounting region is preferably formed close to the second, open end of the feeder body. Preferably, the mounting regions of the multiple guide parts arranged so as to be distributed along the outer surface of the feeder wall form an outer diameter which, in terms of its dimensions, is smaller than the inner diameter at the inner side of the feeder element. Preferably, the inner diameter of the feeder element has sufficient play in relation to the outer diameter of the mounting regions of the guide parts on the feeder body according to the invention.

Preferably, the mounting section of the guide part has a mounting surface which runs so as to be inclined at an angle $\alpha 3$ with respect to the central axis of the passage opening, which angle differs from the angle $\alpha 1$ of the sliding surface of the sliding section, wherein the inclination angles of mounting surface and sliding surface have the same opening direction. With the mounting surfaces, which run so as to be inclined with respect to the central axis of the passage opening, of the mounting regions on the various guide parts, the mounting and radial orientation of a feeder element that is to be mounted onto the feeder body are further simplified. The assembly of a feeder insert that is made up of a feeder body and of a feeder element that is to be joined to the feeder body is thus facilitated. Preferably, the inclination angle $\alpha 3$ of a respective mounting surface of the mounting region is greater than the inclination angle $\alpha 1$ of the sliding surface of the sliding section, which directly adjoins the mounting section, of the guide part. Preferably, the transition region between the mounting surface and the sliding surface on the guide part is also of step-free form in order that the feeder element can pass over more easily.

Preferably, the holding element projects outward directly on the guide part or is arranged so as to project outward on the outer surface adjacent to the guide part. In a preferred embodiment, the holding element which holds the feeder element in the initial position relative to the feeder body is preferably formed on the guide part which protrudes on the outer surface of the feeder body according to the invention. In this way, regions of the guide part are used as a base structure for the attachment of the holding element to the outer surface of the feeder wall. A structurally simple attachment of the holding element, which commonly protrudes furthest on the outer surface of the feeder body, to the feeder wall is achieved in this way. In another configuration of the feeder body according to the invention, the holding element may also be arranged separately from the guide part on the outer surface of the feeder wall.

Preferably, the holding element is arranged so as to project approximately radially on the sliding section of the guide part, and the supporting section extends proceeding from the holding element in the direction of the first end of the feeder body. Aside from the structural reinforcement of the guide part, in particular of the sliding section, the supporting section furthermore has the function of supporting the holding element on the guide part in the direction of the passage opening. In this way, the risk of premature breakaway of the holding element on the guide part is further reduced. Furthermore, by means of the support of the holding element in the direction of the passage opening on the feeder body according to the invention during the targeted separation of the holding element, a breakaway of surface regions on the sliding surface of the guide part is avoided. The holding element is preferably arranged at that end region of the sliding section which faces toward the supporting section. In the case of a vertical orientation of the feeder body according to the invention, the holding element is arranged or formed at the lower end of the sliding section of the guide part.

A preferred refinement of the feeder body according to the invention provides that the sliding section has a sliding surface which runs approximately parallel to the outer surface of the feeder wall in a direction of extent of the guide part. It is preferably also the case that at least one section of the feeder wall that forms the feeder body has an external cross section which widens along the longitudinal axis of the feeder body in the direction of the passage opening. The longitudinal axis of the feeder body runs in particular coaxially with respect to the central axis of the passage opening. Preferably, a uniform gap is formed between the outer surface of the feeder wall of the feeder body according to the invention and an inner side of the feeder element that corresponds with the feeder body.

Preferably, the one or more guide parts have a direction of extent running approximately parallel to the central axis, wherein, preferably, the mounting section and/or the sliding section has a width transversely with respect to the direction of extent of the guide part, said width widening in the direction of the first end of the feeder body. With the width at the mounting surfaces and/or the sliding surfaces which increases in the direction of the sliding movement, reliable sliding during the relative movement of feeder body and feeder element during the mold material compaction during the production of the casting mold is further improved. A misalignment or tilting of a feeder element on or relative to the feeder body according to the invention is avoided by way of the surfaces which preferably widen in a movement direction.

The holding element is preferably arranged so as to be uniformly spaced apart from the side edges of the sliding surface on the guide part. The holding element, which is arranged preferably centrally on the sliding section, has a width which lies in a range from approximately one third to approximately one half of the width of the sliding section. Preferably, surface regions of the sliding surface are formed in each case to both sides of the holding element.

In one refinement of the feeder body according to the invention, the supporting section has a width transversely with respect to the direction of extent of the guide part, said width decreasing in the direction of the first end of the feeder body. In this way, optimized force introduction or transmission of the forces received by the supporting section into the regions of the feeder wall that bear the supporting section is achieved. Preferably, the width of the supporting section decreases in the direction of extent in the range from approximately 0.15 to approximately 0.3 in relation to the greatest overall width of the supporting section.

In a preferred refinement of the feeder body according to the invention, the feeder wall has a sleeve section, with an external cross section which widens from the second end in the direction of the first end, and has a mounting region, which adjoins the sleeve section and which serves for mounting on a mold model or on a mold plate and which has a cross section which narrows in the direction of the first end. In the present case, the feeder body is divided into two functional regions. The upper functional region, which is assigned to the second end of the feeder body, with its sleeve section allows the relative movement between feeder body and feeder element in order to form a telescopic feeder insert according to the invention. The sleeve section preferably has a height in the direction of the longitudinal axis of the feeder body, which height corresponds approximately to half, preferably more than half, of the overall height of the feeder body according to the invention. A mounting region is provided on the feeder body according to the invention so as to directly adjoin the sleeve section, which mounting region is configured for mounting on a mold model or on a mold plate. The mounting region of the feeder body according to the invention furthermore has an external cross section which narrows from the sleeve section in the direction of the first end of the feeder body.

The guide part according to the invention, with its mounting region, its sliding section, its supporting section and the holding element arranged on the sliding section, extends along the sleeve section from the second end of the feeder body according to the invention in the direction of the transition between sleeve section and mounting region of the feeder body. The one or more guide parts extend preferably over the entire height of the sleeve section. The upper and the lower end of the guide section each end preferably with the outer circumference of the outer surface of the sleeve section. Accordingly, a step-free transition is formed from the mounting region, at the upper end, to the sleeve section and from the supporting section, at the lower end, to the sleeve section. By contrast to the domed outer contour of the sleeve section, the mounting surface on the mounting section, the sliding surface on the sliding section and the terminating surface on the supporting section have a planar form in the direction of extent of the guide part and transversely with respect to the direction of extent. In a preferred embodiment of the single-piece feeder body, the sliding surface of the sliding section projects approximately 1.5 mm on the outer surface of the feeder wall that forms the sleeve section. The mounting surface and the terminating surface are preferably each inclined with respect to the sliding surface, and end at the end side at the outer surface of the feeder wall. The holding element forms, on the sliding surface, a semicylindrical structural part which has a radius of approximately 2 mm and a height of approximately 5 mm in the case of an overall height of the guide part of approximately 35 mm and a maximum width of the guide part at its widest point of approximately 10 mm. The dimensions of the guide part and of the holding element in relation to the overall height of the guide part in the direction of extent are to be adapted depending on the size of the feeder body according to the invention that is planned for use.

In a refinement, the feeder body according to the invention is preferably of rotationally symmetrical form for use as a lower part of a feeder insert. A feeder body of such rotationally symmetrical form can be arranged without an arbitrary preferential direction within a mold cavity for forming a casting mold. In an alternative embodiment, the feeder body according to the invention is of asymmetrical form. In particular, a feeder body of a side feeder for use in vertically separable casting molds is of asymmetrical form, wherein such a feeder body according to the invention preferably has a volume center of gravity of the feeder cavity which is offset in relation to the central axis of the passage opening. A feeder body of such asymmetrical form also preferably has, on its outer surface, one or more guide parts according to the invention as described further above, with the supporting sections thereof.

A single-piece feeder body according to the invention is preferred, wherein the feeder body (i) is formed from exothermic feeder material or comprises exothermic feeder material at least in certain sections, and/or (ii) is formed from insulating feeder material or comprises insulating feeder material in certain sections. With the use of exothermic feeder material, material situated in the feeder cavity is preferably kept in the liquid state over a relatively long period of time. Preferably, in one embodiment, the entire single-piece feeder body is formed from an exothermic feeder material. Alternatively or optionally, the feeder body according to the invention may also be composed entirely or even only partially of an insulating feeder material, in particular quartz sand, which is bound with binding agent and with which the release of heat from the interior of the feeder body is reduced in a simple manner.

A further aspect of the present invention relates to a two-part or multi-part feeder insert for use in metal casting in casting molds. It is provided according to the invention that the feeder insert comprises at least one feeder body according to the invention, which is preferably designed according to any of the preferred embodiments above, and one or more further feeder elements, wherein the feeder body is connected to the one or the further feeder elements to form a telescopic feeder insert, and wherein the feeder body together with the one further or together with at least one of the further feeder elements defines the feeder cavity. The invention thus relates to a multi-part feeder insert, in the case of which the feeder body according to the invention interacts with at least one further feeder element to form the feeder cavity, wherein the feeder body and the at least one feeder element are designed to be telescopic relative to one another. For the use according to the invention, the multi-part feeder insert is assembled from the single-piece feeder body and the at least one feeder element. In the present case, a two-part or multi-part feeder insert is to be understood in particular to mean a feeder insert which is assembled from the single-piece feeder body according to the invention and at least one individual further feeder element. According to a preferred configuration, the feeder body according to the invention and the at least one further feeder element can, before their actual use in a casting mold, be reversibly separated from one another and joined together again as often as desired.

During the telescoping of feeder body and feeder element relative to one another, a relative movement in the direction of the longitudinal axes of feeder body and feeder element with respect to one another preferably occurs. In the case of such a multi-part feeder insert, also referred to as "telescopic feeder", one part of the feeder insert (for example the feeder body) is pushed into the other part, or one part of the feeder insert (for example the feeder body) is pushed over the other part, during the compaction of the mold material during the production of the casting mold. Preferably, during the compaction of the mold material used to form the casting mold, the feeder element is pressed at least in certain sections over the feeder body, which preferably stands fixedly on a mold plate or on a mold model. The feeder body and feeder element are preferably generally of inherently non-deformable form.

A yet further aspect of the present invention relates to a kit for producing feeder inserts, comprising one or more feeder bodies according to any of the preferred embodiments described above, and at least two further feeder elements which correspond with the one or more feeder bodies according to the invention according to any of the preferred embodiments described above such that two or more different feeder inserts can be generated, the feeder cavities of which have different volumes.

The invention is in this respect based on the additional concept of being able to assemble a single feeder body according to the invention with different feeder elements, which are of different configuration, to form a feeder insert. Preferably, the one or more feeder bodies have in each case one coupling section which is designed to be complementary to or to correspond with a respective coupling region of a feeder element to be joined together therewith. In order to be able to combine different feeder bodies according to the invention with different feeder elements, the coupling regions of the different feeder bodies and the coupling regions of the different feeder elements are preferably in each case of identical form. The coupling region on the feeder body has at least one guide part, which guide part has a supporting section which protrudes outwardly on the outer surface and which, preferably adjoining the sliding section of the guide part for guiding the feeder element, extends in the direction of the passage opening.

Furthermore, the kit according to the invention preferably comprises a centering mandrel which corresponds with the passage opening in the one feeder body or in at least one of the at least two feeder bodies according to any of the preferred embodiments described above. A perpendicular orientation of the feeder insert with the feeder body according to the invention and with the feeder element with respect to the mold plate or with respect to the mold model is preferably realized by means of the centering mandrel. The centering mandrel preferably has a centering mandrel base which has a shaping adapted to the shape of the passage opening. In a preferred embodiment, in which the passage opening does not comprise a cylindrical cross section but preferably has a cross section preferably selected from the group comprising oval, non-circular, flattened circle and polygonal, and the cross section of the centering mandrel base is of complementary form with respect to the cross section of the passage opening, at least the one or more feeder bodies are received in form-fitting fashion on the centering mandrel. Preferably, a rotation-preventing securing action is generated between the centering mandrel and the one or more feeder bodies, whereby the feeder body can be brought into contact with the centering mandrel in one or more preferential relative positions.

The preferred embodiments and refinements described with regard to the feeder body according to the invention are at the same time or analogously also preferred embodiments of the feeder insert according to the invention and of the kit for producing a feeder element. Preferred embodiments or refinements which are described herein with regard to the feeder insert or with regard to the kit for producing a feeder insert and which refer to the feeder body are simultaneously also preferred embodiments of the feeder body, etc.

Figure 2:
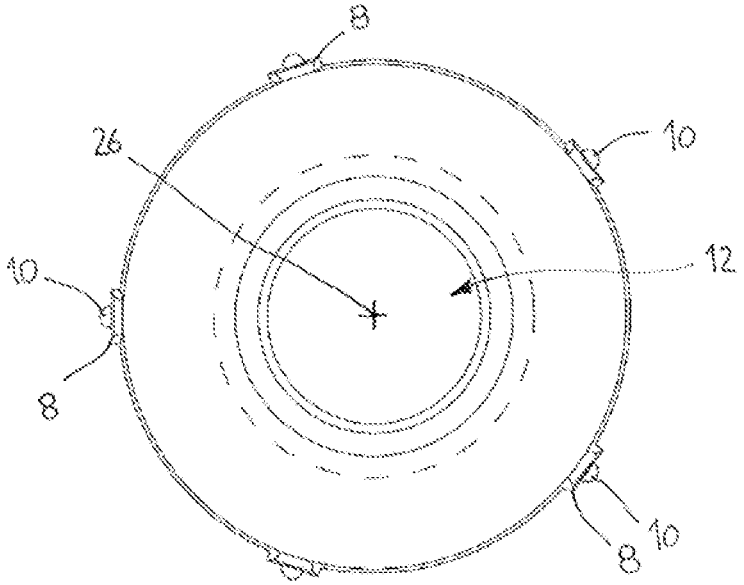
Figure 3:
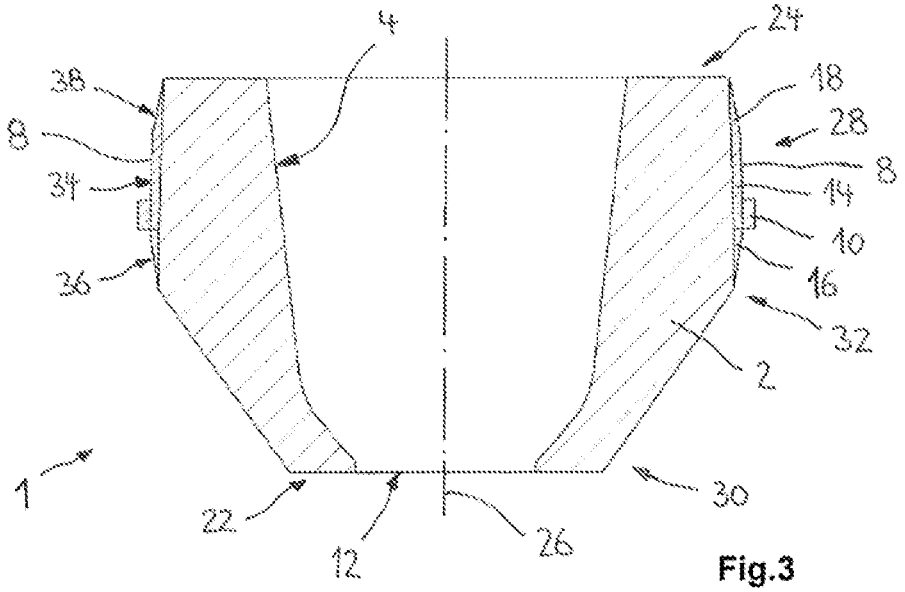
Figure 3A:
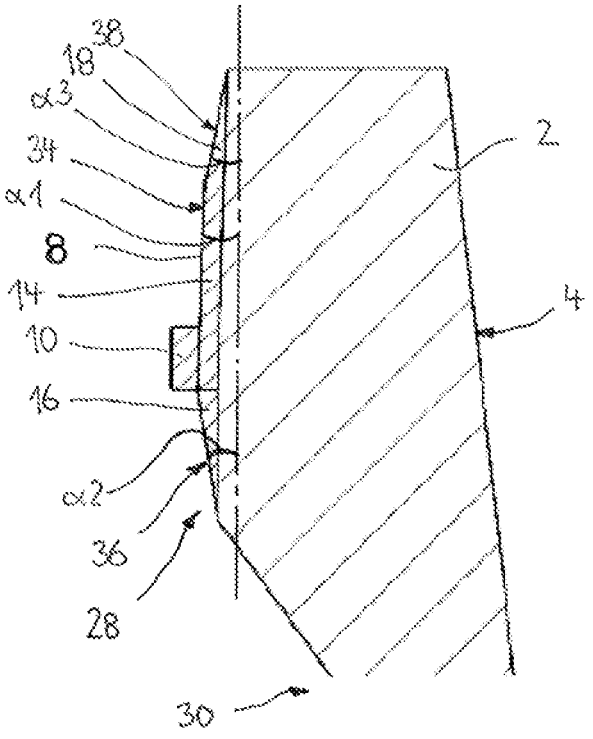
Figure 4:
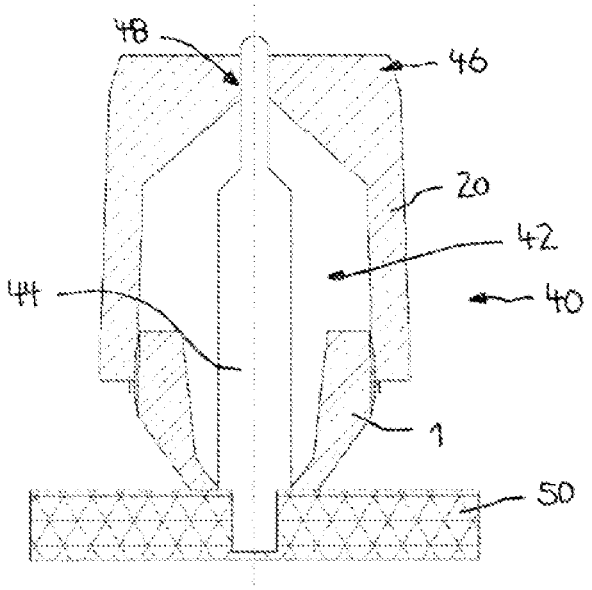
Figure 5:
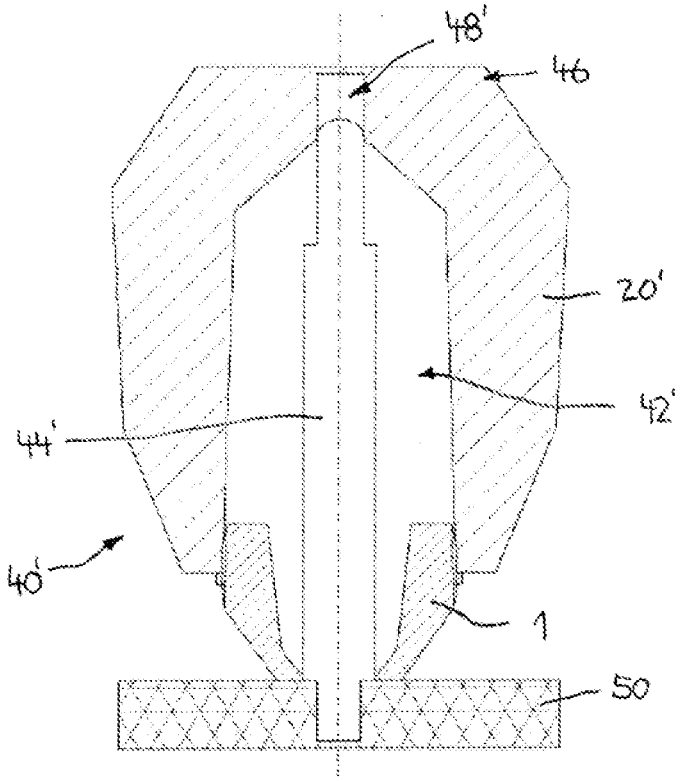
Figure 6:
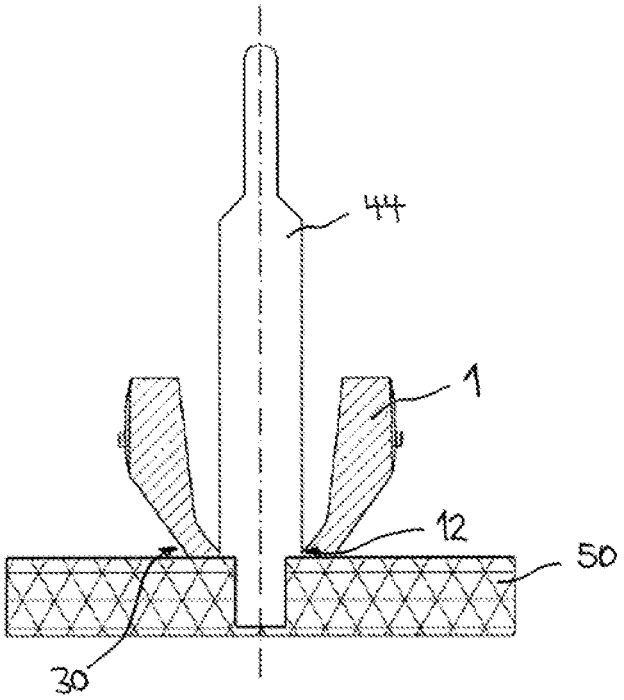

The invention will be described in more detail below, with reference to the appended figures, on the basis of a preferred exemplary embodiment of a feeder body according to the invention and of a feeder insert according to the invention, from which further features which are preferred for the present invention are apparent. In the figures:

FIG. 1: shows a perspective illustration of a feeder body according to the invention for use in metal casting;

FIG. 2: shows a view of the feeder body according to the invention as per FIG. 1 from below;

FIGS. 3 and 3*a*: show a sectional illustration and an enlarged sectional illustration of the feeder body according to the invention as per FIG. 1;

FIG. 4: shows a view of a first embodiment of a feeder insert with a feeder body according to the invention;

FIG. 5: shows a view of a further embodiment of a feeder insert with a feeder body according to the invention as per FIG. 1; and FIG. 6-FIG. 9: show views which schematically show the production of a casting mold from the placing-on of a feeder insert according to the invention to the pressing of the mold material used to form the casting mold.

FIG. 1 shows a single-piece feeder body 1 according to the invention which is used in metal casting in a casting mold (not shown in any more detail). The feeder body 1 has a feeder wall 2 with an inner surface 4 which is configured to at least partially delimit a feeder cavity 42, 42' (FIG. 4 and FIG. 5) for receiving liquid metal. The feeder wall 2 of the feeder body furthermore comprises an outer surface 6 on which there is arranged at least one guide part 8 for a feeder element 20, 20' (FIG. 4 and FIG. 5) which corresponds with the feeder body. Furthermore, on the outer surface 6, there is provided at least one outwardly projecting holding element 10 which is configured to hold the feeder element 20, 20' in an initial position relative to the feeder body 1. Furthermore, the feeder wall 2 has a passage opening 12 (FIG. 2 and FIG. 3) which is configured such that liquid metal can enter the feeder cavity 42, 42' (FIG. 4 and FIG. 5).

According to the invention, the feeder body 1 has, on the guide part 8, a sliding section 14 for the feeder element 20 which corresponds with the feeder body, wherein the guide part 8 furthermore has a supporting section 16 which protrudes outwardly on the outer surface 6. The supporting section 16, adjoining the sliding section 14 of the guide part 8, extends in the direction of the passage opening 12. By means of the supporting section 16, the forces that act on the sliding section 14 which is configured for guiding the feeder element 20 is reliably accommodated and dissipated into the adjoining region of the feeder wall 2. Furthermore, the guide part 8 has a mounting region 18, which likewise protrudes outwardly on the outer surface 6 of the feeder wall 2. The feeder body 1 furthermore has a first end 22, which defines the passage opening 12, and a second end 24, which is situated opposite the passage opening. The mounting region 18 extends from the sliding section 14 of the guide part 8 in the direction of the second end 24 on the feeder body 1. The supporting section 16 and the mounting section 18 are arranged at opposite ends of the sliding section 14.

As can be seen from FIG. 2, multiple guide parts 8 are arranged at angular intervals with respect to one another about the central axis 26 (FIG. 3) of the passage opening 12. In the embodiment shown, five guide parts 8 are arranged with an offset of preferably approximately 72 angular degrees with respect to one another on the outer surface 6. The holding element 10 protrudes outwardly directly on the guide part 8. All of the holding elements 10 together form a receptacle for the feeder element 20 that is to be held in an initial position relative to the feeder body.

FIG. 3 shows a sectional illustration of the feeder body 1 according to the invention, which has a sleeve section 28 with an external cross section which widens from the second end 24 in the direction of the first end 22. Furthermore, the feeder body 1 comprises a mounting region 30 which directly adjoins the sleeve section 28 and which serves for mounting on a mold model or on a mold plate 50 (FIG. 4 and FIG. 5). The mounting region 30 has an external cross section which narrows from the sleeve section 28 in the direction of the first end 22. In this way, the feeder body forms a reduced abutment surface against the mold plate 50 that is to be brought into abutment or contact with the feeder body. As is also shown in FIG. 3, the guide part 8 extends along the sleeve section 28. In the embodiment shown, the guide parts 8 extend along the entire height of the sleeve section 28 from the second end 24 of the feeder body 1 to the transition 32 between the sleeve section 28 and the mounting region 30.

The sliding section 14 has a sliding surface 34, and the supporting section 16 has a terminating surface 36. The mounting region 18 has a mounting surface 38 for the mounting of the feeder element 20 on the second end 24 of the feeder body 1. The holding element 10 is arranged so as to project approximately radially on the sliding section 14 of the guide part 8, wherein, in the case of a vertical arrangement of the feeder body according to the invention, the holding element 10 is arranged at the lower end of the sliding section 14 of the guide part 8. The supporting section 16, with its terminating surface 36 which is arranged directly below the holding element 10, extends in the direction of the first end 22 of the feeder body 1. The guide parts 8 have a direction of extent running approximately parallel to the central axis 26 of the passage opening, wherein the mounting section 18 and the sliding section 14 have a width transversely with respect to the direction of extent of the guide part 8, which width widens from the second end 24 in the direction of the first end 22 on the feeder body 1. By contrast, the supporting section 16 has a width transversely with respect to the direction of extent of the guide part, which width decreases in the direction of the first end 22 of the feeder body 1.

As can also be seen from FIG. 3, the inner surface 4 of the feeder wall 2 is formed such that the feeder cavity (FIG. 4 and FIG. 5) which is formed at least partially by the feeder body 1 narrows from the second end 24 on the feeder body 1 in the direction of the passage opening 12 on the first end 22 of the feeder body. In particular, the inner surface 4 has a cross section which narrows in the direction of the passage opening 12. In the embodiment shown, the inner surface 4 has a conical shape in certain sections.

FIG. 3*a* shows, in an enlarged image, the guide part 8 arranged in the region of the sleeve part 28 on the outer surface 6. The guide part 8 is illustrated with different hatching than the rest of the feeder wall in order to illustrate the specific design thereof. The guide part 8 and the feeder wall 2 are preferably of single-piece form, and there is no structural separation between the individual parts of the feeder body 1 that could be assumed from the different hatchings.

As shown in FIG. 3*a*, the sliding surface 34 of the sliding section 14 runs so as to be inclined at an angle $\alpha 1$ with respect to the central axis 26 of the passage opening 12 and the terminating surface 36 of the supporting section 16 runs so as to be inclined at an angle $\alpha 2$ with respect to the central axis 26 of the passage opening 12, wherein the angles $\alpha 1$ and $\alpha 1$ open in opposite directions. For a simplified illustration, the central axis 26 has been relocated into the feeder wall 2. The sliding surfaces 34 and the terminating surfaces 36 of the guide parts 8 are thus inclined in opposite directions in relation to the central axis 26 of the passage opening 12. The mounting surface 38 runs so as to be inclined at an angle $\alpha 3$ with respect to the central axis 26 of the passage opening, wherein the inclination angle $\alpha 1$ of the sliding surface 34 and the inclination angle $\alpha 3$ of the mounting surface 38 have the same opening direction but are of different magnitude in relation to the central axis 26 of the passage opening 12. The sliding surface 34 of the sliding section 14 runs approximately parallel to the outer surface 6 of the feeder wall 2 in the direction of extent of the guide part 8 in the region of the sleeve part 28. The outer diameter of the outer surface 6 of the feeder wall 2, and also the circumference defined by the sliding surfaces 34 of the guide parts 8, widen in the region of the sleeve part 28 from the second end 24 in the direction of the first end 22 of the feeder body 1.

As can also be seen from FIG. 3*a*, both the supporting section 16 and the mounting section 18 of the guide part 8 have a step-free transition to the sliding section 14. The supporting section 14, in the direction of the first end 22 of the feeder body 1, ends at the outer surface 6 of the feeder wall 2 in a step-free manner. The mounting section 18 also, in the direction of the second end 24 of the feeder body 1, ends at the outer surface 6 of the feeder wall 2 in a step-free manner.

FIG. 4 shows a first embodiment of a first feeder insert 40 according to the invention, which is formed from the feeder body 1 and from a first feeder element 20. The feeder body 1 and the feeder element 20 together form a feeder cavity 42 for the liquid metal that enters the feeder cavity via the passage opening 12. The feeder body 1 and the feeder element 20 are designed such that the feeder element 20 can, at least in certain sections, be displaced over the outside of the feeder body 1. The feeder body 1 is in particular displaceable in telescopic fashion into the feeder element 20. The feeder body 1 and the feeder element 20 are held in position with respect to one another by means of a centering mandrel 44. Furthermore, on the outer surface 6 of the feeder wall 2 of the feeder body 1, there is arranged a guide part 8 by means of which tilting or misalignment of the feeder element 20 relative to the feeder body 1 during the displacement movement of feeder body 1 and feeder element 20 with respect to one another is prevented. On the guide part 8, there is arranged a holding element 10 by means of which the feeder element 20 is held in an initial position prior to the displacement of the feeder element relative to the feeder body 1. The feeder element 20 has, at its upper end 46, a receptacle 48 for the tip of the centering mandrel 44.

FIG. 5 shows a second embodiment of a feeder insert 40' which is assembled from the feeder body 1 according to the invention and a further feeder element 20' which corresponds with the feeder body 1. As illustrated by FIG. 5, the feeder body 1 according to the invention can correspond with different feeder elements 20, 20'.

The feeder body 1 and the feeder element 20' interact with one another in a manner virtually identical to that described with regard to FIG. 4. By contrast to the feeder insert 40 from FIG. 4, the feeder insert 40' has an enlarged feeder cavity 42' for receiving the liquid metal. At the closed, upper end 46 of the feeder element 20', there is provided a receptacle 48' for the centering mandrel 44'.

FIGS. 6-9 show an exemplary embodiment of a method for producing at least one mold part (not shown in any more detail) of a casting mold, wherein a feeder body 1 designed according to the invention is pushed or mounted with its passage opening 12 onto a centering mandrel 44. The centering mandrel 44 is fastened to a mold plate 50, which defines at least surface regions of the mold part to be produced (not shown in any more detail). The feeder body 1 abuts directly by way of its mounting region 30 against the mold plate 50.

Figure 7:
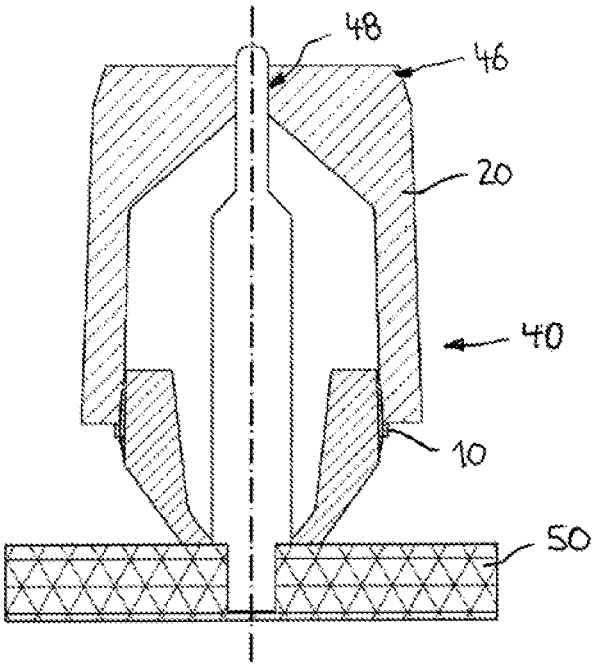

In the next step, shown in FIG. 7, the feeder element 20 is mounted with its lower end on the mounting section 18 of the guide part 8, and the receptacle 48 at the upper end 46 of the feeder element 20 is pushed over the tip of the centering mandrel 44, and the feeder element 20 is thus assembled with the feeder body 1 to form a feeder insert 42 according to the invention. The feeder element 20 is displaced as far as into its initial position on the feeder body 1 until the feeder element 20 has been placed into abutment with the holding elements 10 which project radially outwardly on the guide parts 8.

Figure 8:
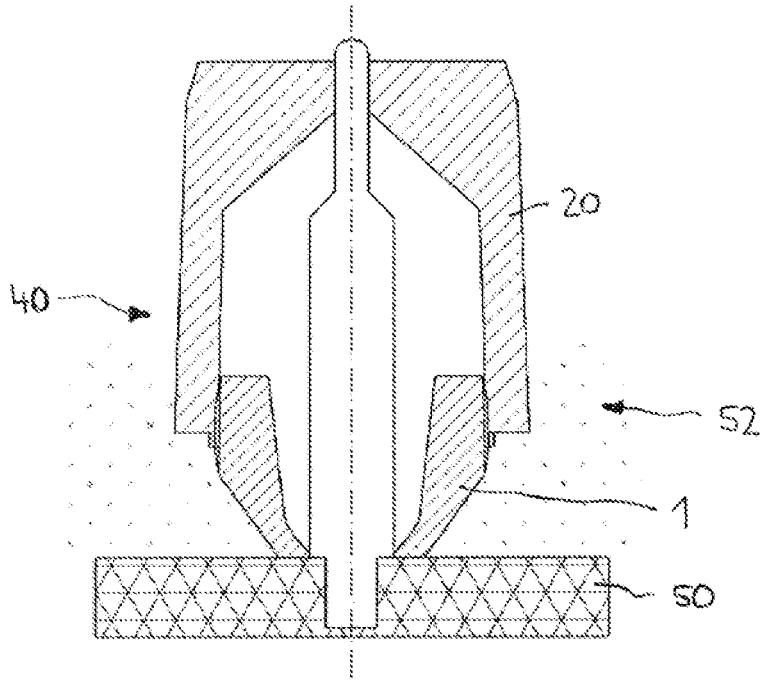

In the method step shown in FIG. 8, a mold material 52 is introduced into a mold (not illustrated in any more detail). With the introduction of the mold material 52, the feeder insert 40 which is formed from feeder body 1 and the feeder element 20 is completely surrounded on the outside by the mold material 52.

Figure 9:
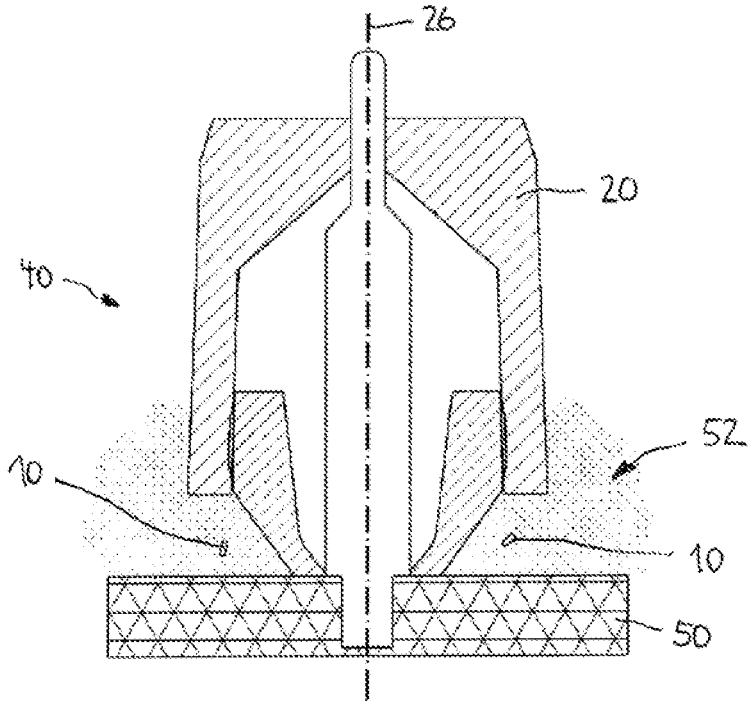

Subsequently, as shown in FIG. 9, the mold material 52 within the mold is compressed, whereby the mold material 52, as indicated, is compacted and forms a solid mold part. With the compaction, the feeder element 20 is displaced parallel to the central axis 26 of the passage opening 12 in the direction of the mold plate 50. With the displacement of the feeder element 20 over the feeder body 1, the holding elements 10 arranged on the guide parts 8 are severed from the guide part 8. Furthermore, the feeder cavity 42 of the feeder insert 40 is reduced in size. The feeder element 20 furthermore runs on the circumference which is formed by means of the sliding surfaces 34 of the sliding sections 14 of the guide part 8 (FIG. 3*a*) and which widens in the direction of the first end 22 on the feeder body 1. The one or more sliding sections 14 which project on the outer surface 6 of the feeder wall 2 each form, with their sliding surfaces 34 of the guide parts 8, a type of run-on bevel for the feeder element 20 which can be displaced over the feeder body 1.

REFERENCE DESIGNATIONS

1 Feeder body
2 Feeder wall
4 Inner surface
6 Outer surface
8 Guide part
10 Holding element
12 Passage opening
14 Sliding section
16 Supporting section
18 Mounting section
20, 20' Feeder element
22 First end
24 Second end
26 Central axis
28 Sleeve section
30 Mounting region
32 Transition
34 Sliding surface
36 Terminating surface
38 Mounting surface
$\alpha 1$, $\alpha 2$, $\alpha 3$ Inclination angle
40, 40' Feeder insert
42, 42' Feeder cavity
44, 44' Centering mandrel
46 End
48, 48' Receptacle
50 Mold plate
52 Mold material

I claim:

1. A single-piece feeder body (1) for use as a component of a two-part or multi-part telescopic feeder insert (40, 40') in metal casting, having a feeder wall (2) which at least partially delimits a feeder cavity (42, 42') for receiving liquid metal, wherein the feeder wall (2) has a passage opening (12) for the liquid metal into the feeder cavity (42, 42'), and an outer surface (6) on which there are arranged at least one outwardly projecting holding element (10) and at least one guide part (8) with a sliding section (14) for a feeder element (20, 20'), wherein an inner side of the feeder element (20, 20') corresponds with an outer surface of the feeder wall of the feeder body (1), wherein the guide part (8) has a supporting section (16) which protrudes outwardly on the outer surface (6) and which, adjoining the sliding section (14) of the guide part (8) for guiding the feeder element (20, 20'), extends in the direction of the passage opening (12); and wherein the sliding section (14) has a sliding surface (34) and the supporting section (16) has a terminating surface (36), wherein the sliding surface (34) runs so as to be inclined at an angle ($\alpha 1$) with respect to the central axis (26), and the terminating surface (36) runs so as to be inclined at an angle ($\alpha 2$) with respect to the central axis (26) of the passage opening (12), wherein the angles ($\alpha 1$, $\alpha 2$) open in opposite directions;

whereby when the feeder element (20, 20') slides down the sliding section (14) towards the passage opening (12), the terminating surface (36) does not come into contact with the inner side of the feeder element (20, 20').

2. The feeder body (1) as claimed in claim 1, wherein multiple guide parts (8) are arranged at angular intervals with respect to one another about the central axis of the passage opening (12).

3. The feeder body (1) as claimed in claim 1, wherein five guide parts (8) are arranged with an offset of approximately 72 angular degrees with respect to one another on the outer surface (6).

4. The feeder body (1) as claimed in claim 1, wherein the feeder body (1) has a first end (22), which defines the passage opening (12), and a second end (24), which is situated opposite the passage opening (12).

5. The feeder body (1) as claimed in claim 1, wherein the one or more guide parts (8) has a mounting section (18) which extends from the sliding section (14) in the direction of the second end (24) and which protrudes on the outer surface (6).

6. The feeder body (1) as claimed in claim 5, wherein the mounting section (18) of the guide part (8) has a mounting surface (38) which runs so as to be inclined at an angle ($\alpha 3$) with respect to the central axis (26) of the passage opening (12), which angle differs from the angle ($\alpha 1$) of the sliding surface (34) of the sliding section (14), wherein the inclination angles of mounting surface (38) and sliding surface (34) have the same opening direction.

7. The feeder body (1) as claimed in claim 1, wherein the holding element (10) projects outward directly on the guide part (8) or is arranged so as to project outward on the outer surface (6) adjacent to the guide part (8).

8. The feeder body (1) as claimed in claim 4, wherein the holding element (10) is arranged so as to project approximately radially on the sliding section (14) of the guide part (8), and the supporting section (16) extends proceeding from the holding element (10) in the direction of the first end (22) of the feeder body (1).

9. The feeder body (1) as claimed in claim 1, wherein the sliding section (14) has a sliding surface (34) which runs approximately parallel to the outer surface (6) of the feeder wall (2) in a direction of extent of the guide part (8).

10. The feeder body (1) as claimed in claim 1, wherein the one or more guide parts (8) have a direction of extent running approximately parallel to the central axis (26), wherein the mounting section (18) and/or the sliding section (14) has a width transversely with respect to the direction of extent of the guide part (8), said width widening in the direction of the first end (22) of the feeder body (1).

11. The feeder body (1) as claimed in claim 10, wherein the supporting section (16) has a width transversely with respect to the direction of extent of the guide part (8), said width decreasing in the direction of the first end (22) of the feeder body (1).

12. The feeder body (1) as claimed in claim 1, wherein the feeder wall (2) has a sleeve section (28), with an external cross section which widens from the second end (24) in the direction of the first end (22), and has a mounting region (30), which adjoins the sleeve section (28) and which serves for mounting on a mold model or on a mold plate (50) and which has a cross section which narrows in the direction of the first end (22).

13. The feeder body (1) as claimed in claim 1, wherein the one or more guide parts (8) extends along the sleeve section (28) from the second end (24) of the feeder body (1) in the direction of the transition (32) between sleeve section (28) and mounting region (30).

14. The feeder body (1) as claimed in claim 1, wherein the feeder body (1)

(i) is formed from exothermic feeder material or comprises exothermic feeder material in certain sections, and/or (ii) is formed from insulating feeder material or comprises insulating feeder material in certain sections.

15. A two-part or multi-part feeder insert (40, 40') for use in metal casting in casting molds, comprising the feeder body (1) as claimed in claim 1, and one or more further feeder elements (20, 20'), wherein the feeder body (1) is connected to the one or more further feeder elements (20, 20') to form a telescopic feeder insert (40, 40'), and wherein the feeder body (1) together with the one or more further feeder elements (20, 20') defines the feeder cavity (42, 42').

16. A kit for producing feeder inserts (40, 40'), comprising one or more feeder bodies (1) as claimed in claim 1, and at least two further feeder elements (20, 20') wherein an inner side of the feeder elements (20,20') corresponds with an outer surface of the feeder wall of the one or more feeder bodies (1) such that two or more different feeder inserts (40, 40') can be generated, the feeder cavities (42, 42') of which have different volumes.

17. The kit as claimed in claim 16, comprising a centering mandrel (44, 44') which has a shaping which corresponds with a shape of the passage opening (12) in the one or more feeder bodies (1).

18. The feeder body (1) as claimed in claim 1, wherein multiple guide parts (8) are arranged at angular intervals with respect to one another about the central axis of the passage opening (12) at uniform angular intervals about the central axis (26) of the passage opening (12).

19. The feeder body (1) as claimed in claim 1, wherein the feeder body (1) has a first end (22), which defines the passage opening (12), and a second end (24), which is situated opposite the passage opening (12), and wherein the supporting section (16) has a step-free transition to the sliding section (14), and/or, in the direction of the first end (22) of the feeder body (1), ends at the outer surface (6) of the feeder wall (2) in a step-free manner.

* * * * *